US007021502B1

(12) United States Patent
Ray et al.

(10) Patent No.: US 7,021,502 B1
(45) Date of Patent: Apr. 4, 2006

(54) DISPENSING DEVICE FITTED WITH FIXING RING

(75) Inventors: Dany Ray, Juziers (FR); Franck Plessis, Neubourg (FR)

(73) Assignee: Valois S.A., Le Neubourg (FR)

( * ) Notice: Subject to any disclaimer, the term of this patent is extended or adjusted under 35 U.S.C. 154(b) by 340 days.

(21) Appl. No.: 10/088,050

(22) PCT Filed: Sep. 12, 2000

(86) PCT No.: PCT/FR00/02516

§ 371 (c)(1),
(2), (4) Date: Aug. 12, 2002

(87) PCT Pub. No.: WO01/19703

PCT Pub. Date: Mar. 22, 2001

(30) Foreign Application Priority Data

Sep. 15, 1999 (FR) ..... 99 11501

(51) Int. Cl.
*B65D 88/54* (2006.01)

(52) U.S. Cl. ..... 222/321.9; 222/321.7; 222/385

(58) Field of Classification Search .. 222/321.1–321.9, 222/402.1–402.25, 383.1, 385
See application file for complete search history.

(56) References Cited

U.S. PATENT DOCUMENTS 2,889,964 A * 6/1959 Cooprider ..... 222/321.9
3,191,815 A * 6/1965 Lambert et al. ..... 222/402.1
3,211,346 A * 10/1965 Meshberg ..... 222/321.9
3,596,808 A * 8/1971 Corsette ..... 222/321.9
3,937,366 A * 2/1976 Steiman ..... 222/321.9
3,977,575 A * 8/1976 Macquire-Cooper ..... 222/396
4,446,991 A 5/1984 Thompson
4,964,547 A * 10/1990 Lina ..... 222/385
5,096,097 A * 3/1992 Lina ..... 222/385
5,169,038 A * 12/1992 Di Giovanni ..... 222/402.2
5,190,192 A * 3/1993 Lina et al. ..... 222/321.2
5,292,033 A * 3/1994 Gueret ..... 222/95
5,348,174 A * 9/1994 Velicka ..... 215/277
5,509,584 A * 4/1996 Gueret ..... 222/321.7
6,073,805 A * 6/2000 Gueret ..... 222/95
6,073,815 A * 6/2000 Ponton ..... 222/402.21
6,273,300 B1 * 8/2001 de Pous et al. ..... 222/321.9
6,279,786 B1 * 8/2001 de Pous et al. ..... 222/321.9
6,463,650 B1 * 10/2002 Bougamont et al. ..... 29/453

FOREIGN PATENT DOCUMENTS

DE 79 04 531 U 4/1980
DE 31 22 982 A 12/1982

* cited by examiner

*Primary Examiner*—Frederick C. Nicolas
(74) *Attorney, Agent, or Firm*—Sughrue Mion, PLLC

(57) ABSTRACT

A fluid dispenser device designed to be mounted on the neck of a receptacle, said device comprising a dispensing member (1), such as a pump or a valve, and fixing means (2) for fixing the dispensing member to the neck of the receptacle, said dispensing member comprising a body (10) whose top end is provided with a collar (12) that projects outwards, said fluid dispenser device being characterized in that the fixing means comprise a substantially cylindrical ring (20) engaged on the body (10) under the collar, said ring (20) being in peripheral leaktight contact with the body by being radially clamped thereon.

17 Claims, 2 Drawing Sheets

DISPENSING DEVICE FITTED WITH FIXING RING

Figure 1A:
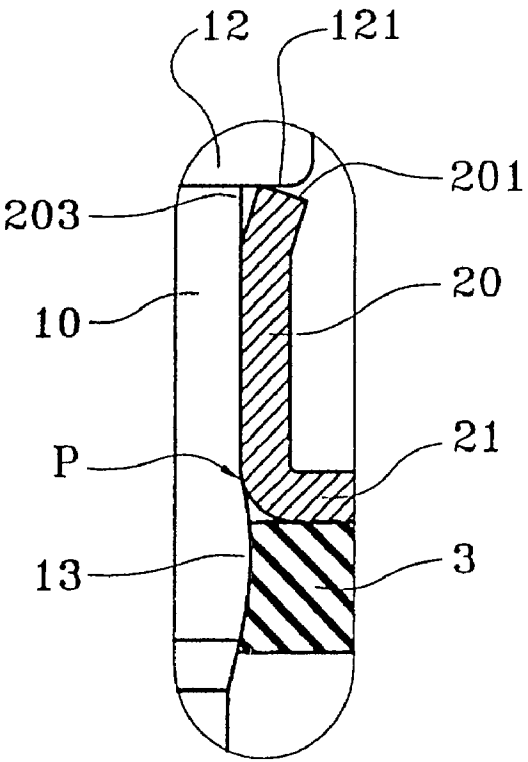

The present invention relates to a fluid dispenser device designed to be mounted on the neck of a receptacle. The device comprises a dispensing member, such as a pump or a valve, and fixing means for fixing the dispensing member to the neck of the receptacle. In the fields of cosmetics, perfumes, or pharmaceuticals, it is frequent to use a pump or a valve mounted on a receptacle containing a fluid to be dispensed. To fix the pump or the valve to the neck of the receptacle, a fixing ring or turret is conventionally used that makes it possible both to take hold of the pump or of the valve, and also to fix it to the neck of the receptacle.

It is also known that the body of the pump or of the valve may be provided with a collar which extends radially outwards. The collar is generally formed at the top end of the body of the pump or of the valve. In conventional fixing means, the collar on the body is used to take hold of the pump or of the valve. When the fixing means are made of metal, they are then in the form of a metal cap in which the collar of the body is crimped. To fix the pump or the valve to the neck of the receptacle, it is then necessary merely to crimp the cap to the outside of the neck of the receptacle. When the fixing means are made of plastic, they are generally provided with a snap-fastening recess into which the collar of the body is inserted by force. To fix the ring made of plastic to the neck of the receptacle, the techniques of screwing or snap-fastening are generally used.

Regardless of whether the fixing means are made of metal or of plastic, they form a recess for the collar of the body of the pump or of the valve, and they therefore extend over the top face of the collar. This gives rise to extra thickness at the top face of the collar, and it also gives rise to an increase in the working diameter of the pump as mounted, because the fixing means extend around the collar.

Document U.S. Pat. No. 4,446,991 describes a dispenser comprising a valve forming a projecting collar at the top end of the body. The projecting collar is engaged with a ring which is clamped around the collar. The ring extends around and above the collar.

An object of the present invention is to solve the above-mentioned problems of the prior art by defining a dispenser device whose fixing means do not come into engagement around or above the collar of the body of the pump or of the valve.

To this end, the present invention provides a fluid dispenser device designed to be mounted on the neck of a receptacle, said device comprising a dispensing member, such as a pump or a valve, and fixing means for fixing the dispensing member to the neck of the receptacle, said dispensing member comprising a body whose top end is provided with a collar that projects outwards, said fluid dispenser device being characterized in that the fixing means comprise a substantially cylindrical ring engaged on the body under the collar, said ring being in peripheral leaktight contact with the body by being radially clamped thereon. Advantageously, the ring defines a top end in abutment under the collar. The ring of the fixing means thus does not encase the collar of the body of the dispensing member, but rather it merely comes into abutment against the bottom face of said collar. In addition, sealing is provided between the ring and the body, thereby preventing any leakage therebetween. The neck gasket of such a dispenser device provides sealing between the neck and the ring only, and not between the ring and the body. According to another characteristic of the invention, which may be implemented with or without peripheral sealing, said body also forms at least one outwardly-projecting bulge situated below the collar, the ring being disposed between the collar and said at least one bulge so that the ring is locked therebetween. The ring is thus literally wedged between the collar and the bulge(s). Advantageously, the ring is of height slightly greater than the distance between the bottom face of the collar and the foot of the bulge. Thus the ring is forced by the rising slope(s) of the bulge(s) against the bottom face of the collar. It can thus be said that the ring of the fixing means is genuinely snap-fastened to the body of the pump or of the valve.

In one embodiment, the bulge extends over the entire periphery of the body so as to form an outwardly projecting bead. In a variant, a plurality of localized bulges are provided that are distributed around the periphery of the body.

The ring may be made of metal or of plastic. Preferably, when the ring is made of metal, the free top end of the ring is provided with an inside bevel to make it easier for the ring to pass over the bulge. This prevents any damage from being done to the body of the pump or of the valve as the free end of the ring passes over it.

According to another characteristic, the ring is extended at its bottom end by a radial flange serving to come into abutment against the neck of the receptacle with a gasket being interposed. In addition, the radial flange is extended downwards by a socket suitable for being crimped, screwed, or snap-fastened onto the neck of the receptacle.

The invention is explained more fully below with reference to the accompanying drawings which give two embodiments of the invention by way of non-limiting example.

Figure 1:
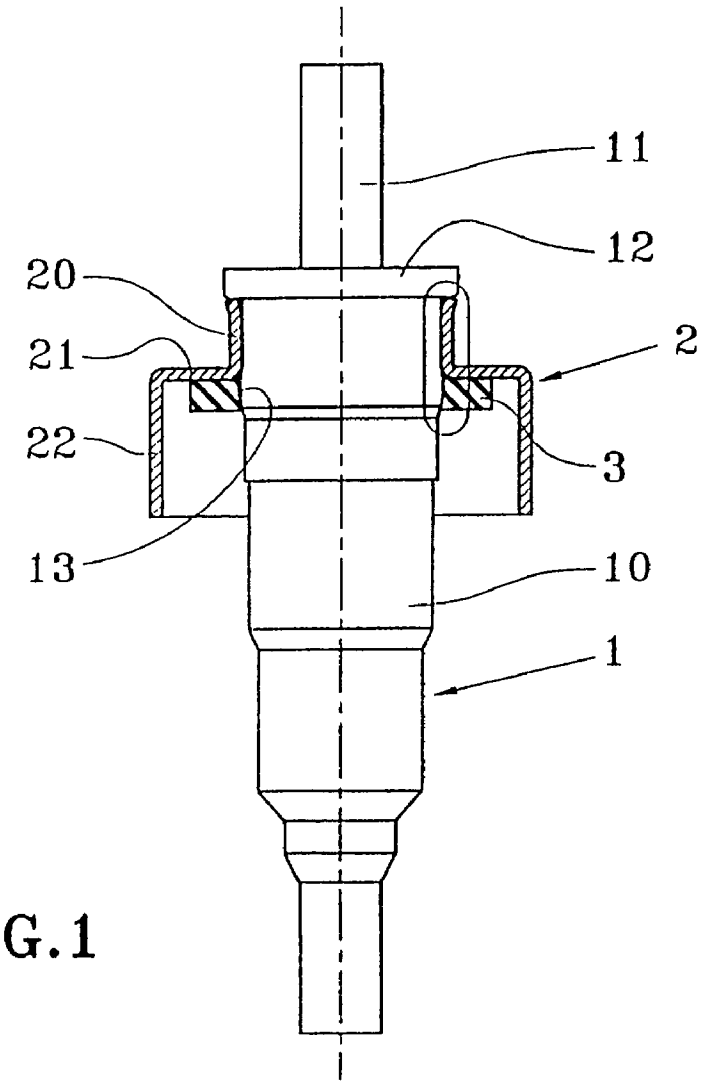
Figure 2:
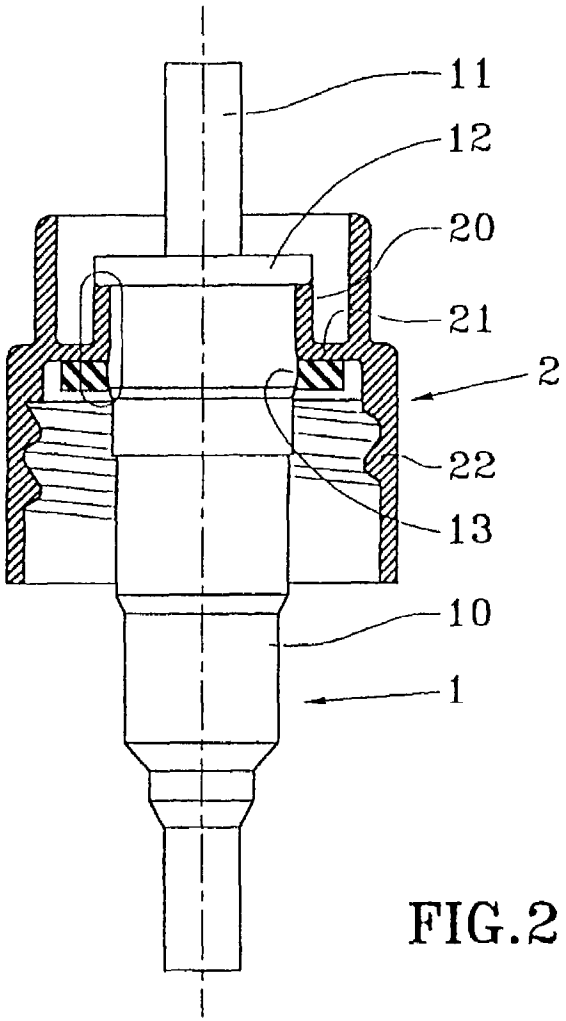
Figure 2A:
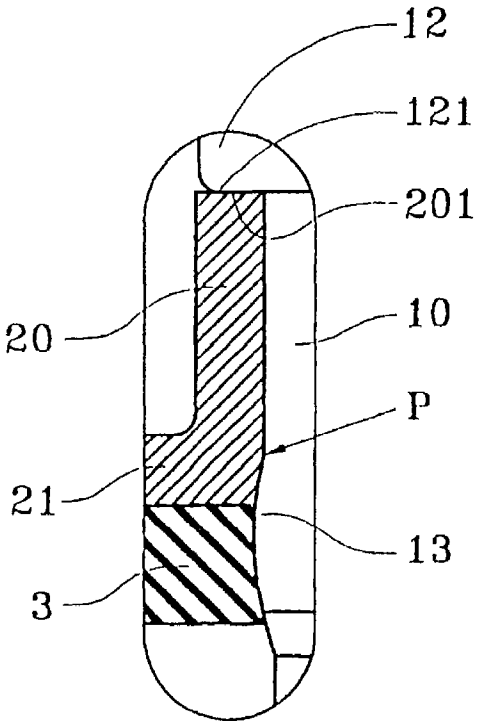

In the drawings:

FIG. 1 is a vertical section view through a dispenser device in a first embodiment;

FIG. 1*a* is an enlarged view of a detail outlined in FIG. 1;

FIG. 2 is a vertical section view through a dispenser device in a second embodiment; and FIG. 2*a* is an enlarged view of a detail outlined in FIG. 2.

The first embodiment shown in FIGS. 1 and 1*a* differs from the second embodiment shown in FIGS. 2 and 2*a* mainly in that the fixing means of the first embodiment are made of metal whereas the fixing means of the second embodiment are made of molded plastic.

With reference to any of the figures, the fluid dispenser device of the invention comprises two main component parts, namely a dispensing member 1, which may be a pump or a valve, and fixing means 2 for fixing the dispensing member 1 to the neck of a receptacle (not shown).

Since the internal structure of the dispensing member is not critical for the present invention, it is not described at all below. Externally, the dispensing member comprises a body 10 underlying an actuating rod 11 which is mounted to move inside the body 10 to actuate the dispensing member. In addition, the body 10 is provided with a collar 12 which projects radially outwards at its top end. Below the collar, the body is cylindrical.

The fixing means comprise a ring 20 which is in the form of a cylindrical segment. In the invention, the ring 20 is engaged on the body 10 so as to generate peripheral sealing around the body. This may be achieved by radial clamping by forming at least one segment of the ring 20 with an inside diameter slightly smaller than the outside diameter of the body. It is thus possible to ensure that the ring is fixed securely to the body, and, in addition, to avoid any risk of leakage between the ring and the body. Advantageously, the top end 201 of the ring comes into abutting contact with the bottom face 121 of the collar 12. The pump cannot therefore by pushed in through the ring.

According to another characteristic of the invention, the body 10 is also provided with one or more bulges 13 that project radially outwards, and that are situated below the collar 12 at a distance of a few millimeters therefrom. The bulge 13 may be in the form of a continuous bead that extends over the entire periphery of the body 10. In a variant, there may be a plurality of bulges 13 in the form of localized projections advantageously distributed uniformly around the periphery of the body. Between the bulges 13 and the collar 12, the pump body forms a cylindrical segment.

The ring is of height such that it is in abutment at its top end 201 under the collar, and engaged via its bottom end with the one or more bulges 13 as can be seen in FIGS. 1*a* and 2*a*. Advantageously, the height of the ring 20 is slightly greater than the distance between the bottom face 121 of the collar 12 and the foot P of at least one bulge 13 so that the bottom end of the ring 20 is urged by the rising slope(s) of the bulge(s) 13 against the bottom face 121 of the collar 12, thereby improving the stability of the ring 20 on the body 10. More particularly, when the fixing means are made of metal, it may be advantageous for the top end of the ring 20 to be provided with an inside bevel 203 to make it easier for the ring to pass over the bulge(s) 13, and thereby to avoid any damage being done either to the bulges or to the body 10. Naturally, such a bevel may also be provided on fixing means made of molded plastic. In practice, a metal ring has a height that is slightly less than the height of a ring made of plastic because the metal ring has smaller deformation. As can be seen in FIG. 2*a*, the bottom end of the ring 20 extends to the vicinity of the outermost point of the bulge 13 by means of its material being deformed slightly, whereas the bottom end of the metal ring shown in FIG. 1*a* extends only very slightly beyond the foot P of the bulge 13 in order to avoid any deformation of the body 10.

Conventionally, the fixing means include a radial flange that extends outwards and that serves to come into abutment against the neck of the receptacle, with a gasket 3 being interposed. This radial flange 21 is connected to the bottom end of the ring 20. Around its outside periphery, the radial flange 21 is extended downwards by a socket 22 serving to be crimped onto the neck of the receptacle when the fixing means are made of metal, or to be screwed or snap-fastened onto the neck of the receptacle when the fixing means are made of molded plastic.

It should be noted that the collar 12 abuts against the top end 201 of the ring 20 so that it is impossible for the body 10 to become disengaged from the ring 20 when actuating the dispensing member by pressing on the actuating rod 11. This offers an advantage over prior art techniques, in which the collar 12 of the dispensing member is snap-fastened from below in a recess so that it is possible for the dispensing member to be disengaged from the recess in the fixing means by pressing strongly on the actuating rod. Such a risk is completely avoided with the present invention.

It can also be noted that the bulge 13 may be implemented on the body 10, and that the ring may be held in place between the collar and the bulge without leaktight contact being established between the ring and the body.

What is claimed is:

1. A fluid dispenser device designed to be mounted on the neck of a receptacle, said device comprising a dispensing member (1) and fixing means (2) for fixing the dispensing member to the neck of the receptacle, said dispensing member comprising a body (10) whose top end is provided with a collar (12) that projects outwards, said fluid dispenser device being characterized in that the fixing means comprise a substantially cylindrical ring (20) engaged on the body (10) under the collar, said ring (20) being in peripheral leaktight contact with the body by being radially clamped thereon;

wherein the ring (20) defines a free top end (201) in abutment under the collar (12); and wherein the body also forms at least one outwardly-projecting bulge situated below the collar, the ring being disposed between the collar and the at least one bulge so that the ring is locked therebetween.

2. A fluid dispenser device according to claim 1, in which the ring (20) is of height slightly greater than the distance between the bottom face (121) of the collar (12) and the foot (P) of the bulge (13).

3. A fluid dispenser device according to claim 1, in which the bulge (13) extends over the entire periphery of the body so as to form an outwardly projecting bead.

4. A fluid dispenser device according to claim 1, in which a plurality of localized bulges (13) are provided that are distributed around the periphery of the body.

5. A fluid dispenser device according to claim 1, in which the ring (20) is made of metal.

6. A fluid dispenser device according to claim 1, in which the ring (20) is made of plastic.

7. A fluid dispenser device according to claim 6, in which the ring is extended at its bottom end by a radial flange (21) that is extended downward by a socket (22) configured to be crimped, screwed, or snap-fastened onto the neck of the receptacle.

8. The fluid dispenser device according to claim 1, wherein the dispensing member is a pump or a valve.

9. The fluid dispenser device according to claim 1, wherein the body is cylindrical between the collar and the bulge.

10. The fluid dispenser device according to claim 1, wherein the ring contacts the body over a substantial length of the ring between the at least one outwardly projecting bulge and the collar.

11. The fluid dispenser device according to claim 10, wherein the ring contacts the bulge and the collar.

12. The fluid dispenser device according to claim 1, wherein the body is cylindrical over an entire length of the body that is in contact with the ring between the collar and the bulge.

13. The fluid dispenser device according to claim 1, wherein the body has a constant outer diameter along an entire length of the body that is in contact with the ring between the collar and the bulge.

14. A fluid dispenser device designed to be mounted on the neck of a receptacle, said device comprising a dispensing member (1) and fixing means (2) for fixing the dispensing member to the neck of the receptacle, said dispensing member comprising a body (10) whose top end is provided with a collar (12) that projects outwards, said fluid dispenser device being characterized in that the fixing means comprise a substantially cylindrical ring (20) engaged on the body (10) under the collar, said ring (20) being in peripheral leaktight contact with the body by being radially clamped thereon;

wherein the body (10) also forms at least one outwardly-projecting bulge (13) situated below the collar (12); and in which a free top end (201) of the ring (20) is provided with an inside bevel (203) to make it easier for the ring (20) to pass over the bulge (13).

15. A fluid dispenser device designed to be mounted on the neck of a receptacle, said device comprising a dispensing member (1) and fixing means (2) for fixing the dispensing member to the neck of the receptacle, said dispensing member comprising a body (10) whose top end is provided with a collar (12) that projects outwards, said fluid dispenser device being characterized in that the fixing means comprise a substantially cylindrical ring (20) engaged on the body (10) under the collar, said ring (20) being in peripheral leaktight contact with the body by being radially clamped thereon;

in which the ring (20) is extended at its bottom end by a radial flange (21) serving to come into abutment against the neck of the receptacle with a gasket (3) being interposed; and wherein the gasket contacts the body.

16. The fluid dispenser device according to claim 15, wherein the dispensing member is a pump or a valve.

17. A fluid dispenser device according to claim 15, wherein the gasket contacts a bottom end of the ring.

* * * * *